US006289517B1

(12) United States Patent
Minkow et al.

(10) Patent No.: US 6,289,517 B1
(45) Date of Patent: Sep. 18, 2001

(54) PADDED GLOVE FOR PROTECTING AND POSITIONING THE HAND OF A WEARER

(75) Inventors: Roger Minkow, Petaluma; Eric B. Edgecumbe, Sunnyvale; Eric L. Horton, Aptos, all of CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 0 days.

(21) Appl. No.: 09/457,214

(22) Filed: Dec. 8, 1999

Related U.S. Application Data

(63) Continuation of application No. 09/282,588, filed on Mar. 31, 1999.

(51) Int. Cl.[7] ..... A41D 19/00

(52) U.S. Cl. ..... 2/161.1; 2/20

(58) Field of Search ..... 2/16, 20, 159, 2/161.1, 161.5, 161.6, 164, 165, 167; 473/458; 602/21, 62

(56) References Cited

U.S. PATENT DOCUMENTS

| | | | | |
|---|---|---|---|---|
| D. 287,424 | | 12/1986 | Berlese | D29/22 |
| D. 288,981 | | 3/1987 | Hale | D29/20 |
| D. 379,680 | | 6/1997 | Fabry | D29/123 |
| D. 381,132 | | 7/1997 | Fabry | D29/123 |
| 2,845,628 | | 8/1958 | Dell . | |
| 3,173,150 | | 3/1965 | Mohler . | |
| 3,363,265 | | 1/1968 | Dunmire . | |
| 3,598,408 | | 8/1971 | Klose | 273/54 B |
| 3,896,498 | | 7/1975 | Pang | 2/20 |
| 4,176,407 | | 12/1979 | Goebel et al. | 2/20 |
| 4,183,100 | | 1/1980 | De Marco | 2/159 |
| 4,561,122 | | 12/1985 | Stanley et al. | 2/20 |
| 4,590,625 | | 5/1986 | Keim | 2/161 A |
| 4,599,920 | | 7/1986 | Schmid | 81/489 |
| 4,617,684 | | 10/1986 | Green et al. | 2/20 |
| 4,691,387 | | 9/1987 | Lopez | 2/161 A |
| 4,754,499 | | 7/1988 | Pirie | 2/20 |
| 4,850,341 | | 7/1989 | Fabry et al. | 128/44 |
| 4,977,621 | | 12/1990 | Richard | 2/20 |
| 5,031,640 | | 7/1991 | Spitzer | 128/878 |
| 5,081,715 | | 1/1992 | Mascia | 2/20 |
| 5,168,578 | * | 12/1992 | Stanley | 2/19 |
| 5,214,799 | * | 6/1993 | Fabry | 2/161 |
| 5,274,846 | * | 1/1994 | Kolsky | 2/2 |
| 5,322,286 | | 6/1994 | Frost | 273/165 |
| 5,350,418 | * | 9/1994 | Janevski et al. | 607/111 |
| 5,575,008 | * | 11/1996 | McBride et al. | 2/161.1 |
| 5,581,809 | * | 12/1996 | Mah | 2/20 |
| 5,675,839 | * | 10/1997 | Gordon et al. | 2/159 |
| 5,697,104 | * | 12/1997 | Welton | 2/159 |
| 5,771,901 | | 6/1998 | O'Brien | 128/878 |
| 5,790,980 | * | 8/1998 | Yewer, Jr. | 2/20 |
| 5,810,753 | * | 9/1998 | Eberbach | 602/21 |
| 5,819,312 | * | 10/1998 | Snyder et al. | 2/16 |
| 5,898,938 | * | 5/1999 | Baylor et al. | 2/20 |

* cited by examiner

*Primary Examiner*—John J. Calvert
*Assistant Examiner*—Katherine Moran
(74) *Attorney, Agent, or Firm*—Knobbe, Martens, Olson & Bear, LLP

(57) ABSTRACT

A padded glove providing improved protection and positioning of the hand of a wearer by anatomically cushioning the pathways of the Ulnar and Median nerves, providing increased thickness of padding in the cushion positioned over the Ulnar and Median nerves, changing the hand position while bicycle riding to decrease the stretch on the nerves, and cushioning the medial aspect on the hand for road-type handlebars is disclosed.

2 Claims, 12 Drawing Sheets

PADDED GLOVE FOR PROTECTING AND POSITIONING THE HAND OF A WEARER

This application is a continuation of Ser. No. 09/282,588 filed Mar. 31, 1999.

FIELD OF THE INVENTION

The present invention relates to protective gloves. Specifically, the present invention relates to protective gloves for use in sports or occupations requiring protective gloves.

BACKGROUND OF THE INVENTION

The use of protective gloves having some form of protective padding on the palms is well known. One such glove disclosed in U.S. Pat. No. 5,581,809 (Mah) describes a protective glove formed with a plurality of digital sheaths distally projecting from between the back and palmar portions for use on the hand of a wearer. Another prior art specialty glove is described in U.S. Pat. No. 4,183,100 (DeMarco). The DeMarco patent describes a glove having a friction patch in the palmar portion of the glove. U.S. Pat. No. 4,691,387 (Lopez) and U.S. Pat. No. 4,590,625 (Keim) describe gloves having friction pads situated on the palm side of the glove and providing friction for the wearer during sporting activities.

Each of the above-mentioned prior art gloves and other prior art gloves provide padding on the palm side of the glove, mainly to provide better friction for the wearer. In other prior art glove implementations, the extra padding or extra protective material is applied to the palm side of the glove to protect the wearer from sharp or abrasive materials. Although these prior art gloves provided padding in various shapes and configurations, these prior art implementations did not recognize the need to protect the Median and Ulnar nerves extending from the wrist into the hand.

U.S. Pat. No. 5,771,901 (O'Brien) describes an ergonomic palmar support apparatus. The O'Brien apparatus is an arch support for the palm side of the hand made of sufficiently rigid material so that it will distribute loads supported by the hand across a wider surface of the palm of the hand, particularly by spanning the carpel tunnel and Guyon's canal to avoid damage to the Median and Ulnar nerves. The O'Brien patent disclosure recognized that hand injuries, particularly those encountered while bicycle riding, resulted from compression of the Ulnar nerve and Median nerve in Guyon's canal. However, O'Brien does not recognize that hand and wrist position is also important in preventing damage to the Ulnar and Median nerves. Further, O'Brien does not disclose a glove. Rather, the O'Brien apparatus is a rigid arch support for the hand.

Thus, a padded glove for protecting and properly positioning the hand of a wearer is needed.

SUMMARY OF THE INVENTION

The present invention is a padded glove providing improved protection and positioning of the hand of a wearer by anatomically cushioning the pathways of the Ulnar and Median nerves, providing increased thickness of padding in the cushion positioned over the Ulnar and Median nerves, changing the hand position while bicycle riding to decrease the stretch on the nerves, and cushioning the medial aspect of the hand for road-type handlebars. The present invention provides improved protection and positioning of the hand by preventing compression of the Ulnar and Median nerves and by changing the hand position while bicycle riding to prevent hyperextension or radial deviation of the wrist.

DETAILED DESCRIPTION OF THE PREFERRED EMBODIMENT

The present invention is a padded glove for protecting and properly positioning the hand of a wearer. In the following detailed description of the preferred embodiment, numerous specific details are set forth in order to provide a thorough understanding of the present invention. It will be evident however to one of ordinary skill in the art that the present invention may be practiced without these specific details. In other instances, well-known structures and devices are shown in block diagram form to order to avoid unnecessarily obscuring the present invention.

Figure 1:
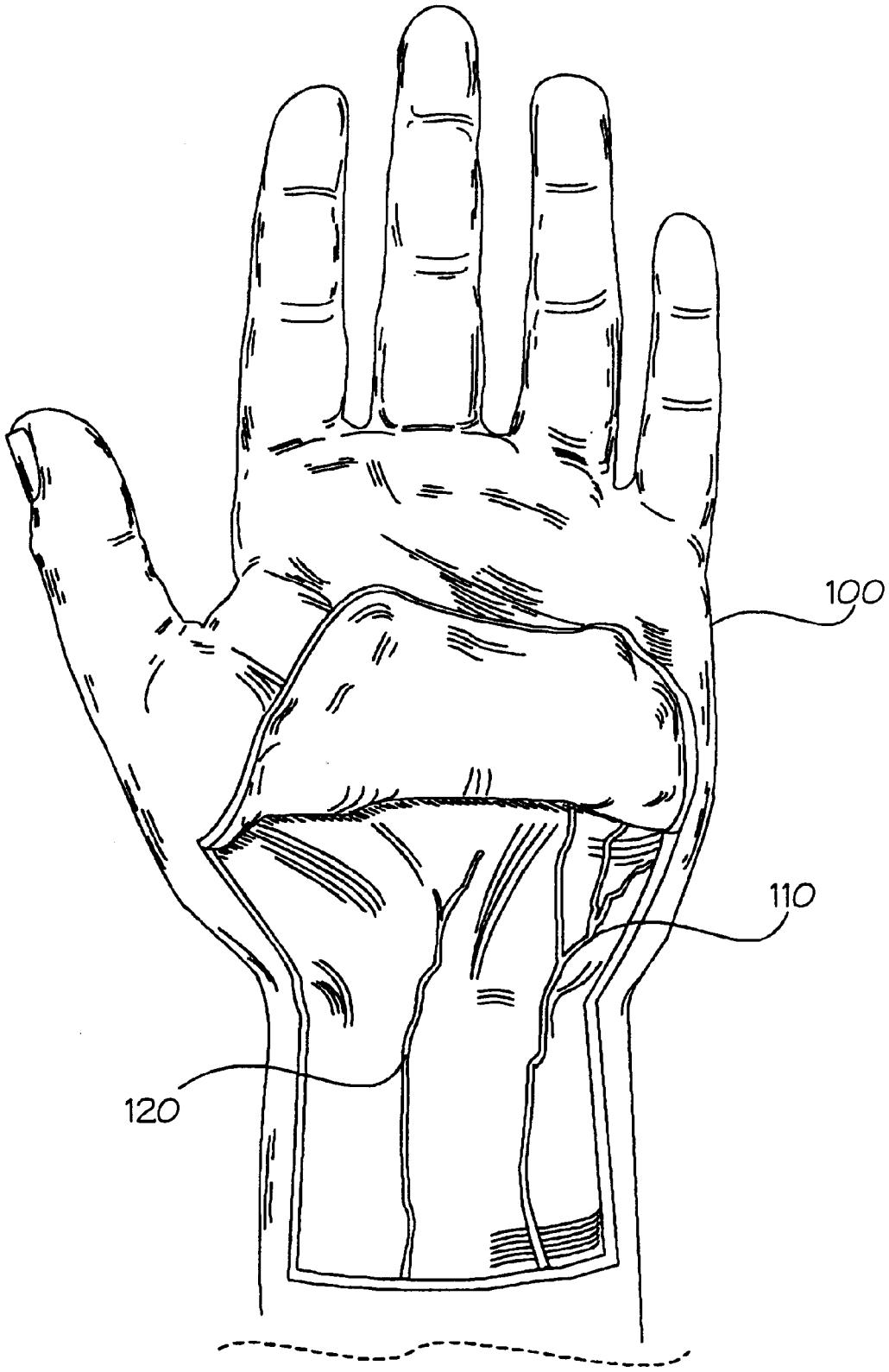
FIG. 1 illustrates the position of the Median and Ulnar nerves in the hand.

Referring to FIG. 1, the well-known anatomy of the human hand is illustrated. Particularly, the human hand includes two nerves, the Median nerve 120 and the Ulnar nerve 110 extending down the arm and wrist and terminating in the palm of the hand as shown in FIG. 1. The Median nerve 120 runs through the carpal tunnel into the hand. In the hand, the Median nerve 120 forms a muscular branch and the palmar digital branches. The muscular branch curves from the lateral side of the Median nerve to supply the muscles of the thenar eminence. The palmar digital branches supply the palmar surface of the thumb, index and middle finger and the medial half of the ring finger. The Ulnar nerve 110 passes into the hand over the flexor retinaculum. In the hand, the Ulnar nerve 110 divides into superficial and deep branches. The superficial branch supplies palmaris brevis and the skin over the palmar surface of the medial one and one-half digits. The deep branch pierces between abductor digiti minimi and flexor digiti minimi to reach the deep palm where it supplies various portions of the hypothenar eminence muscles.

It is well known that compression of the Ulnar and Median nerves, especially occurring during repetitive bicycling, can cause damage to these nerves and thereby result in a loss of motor coordination in the hand.

Figure 2A:
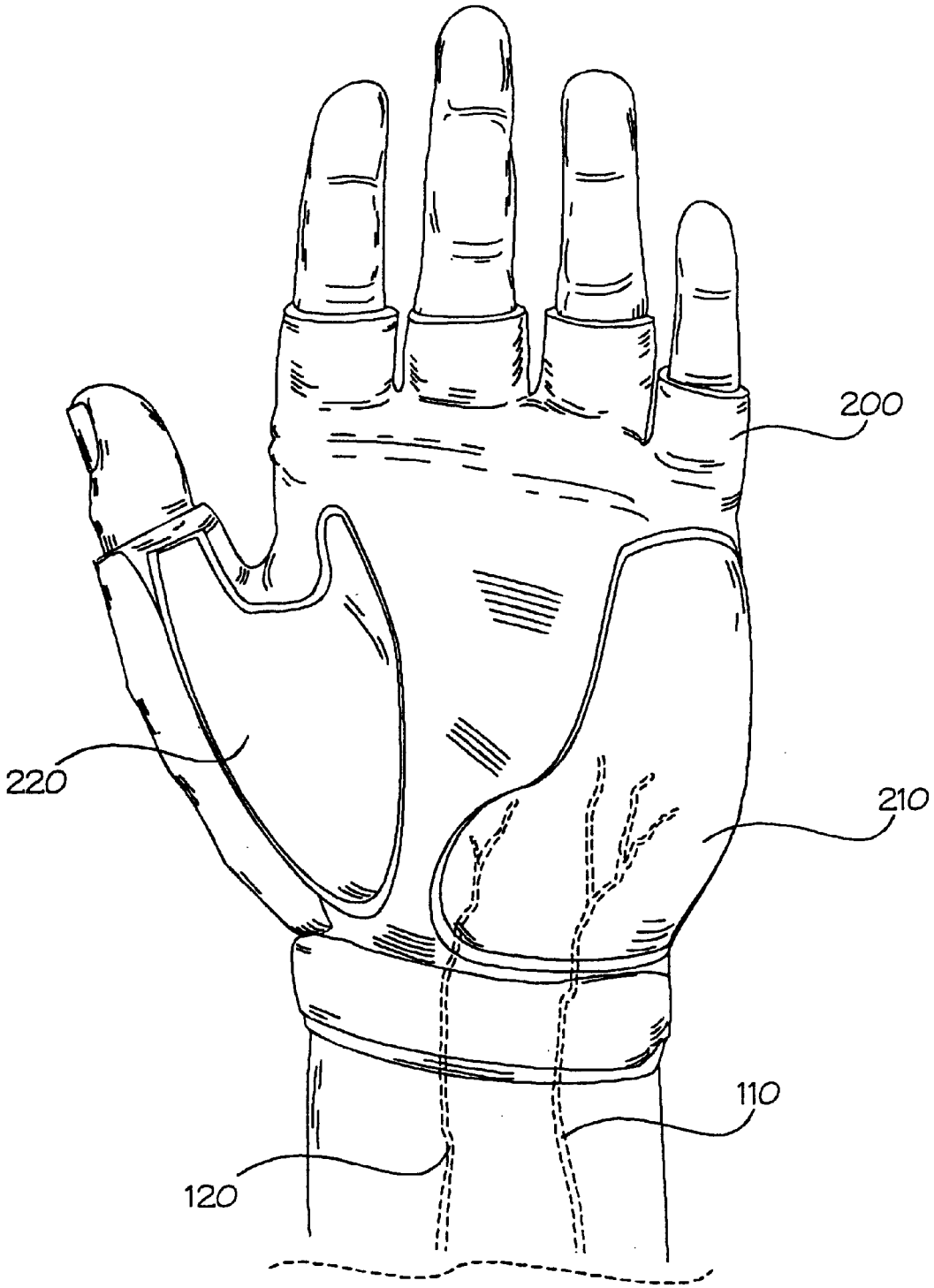
FIG. 2A illustrates the padded glove of the present invention including two padded portions on the palm side of the glove.

Referring now to FIG. 2A, the preferred embodiment of the present invention is illustrated. In the preferred embodiment, a fingerless glove 200 is fitted with padded portions 210 and 220. It would be apparent to one of ordinary skill in the art that a full-figured glove could also be used. Cushions or pads (i.e. padded portions) 210 and 220 can be implemented as any of a variety of conventional padding material such as foam rubber of varying densities and thicknesses, layers of fabric of various types and thicknesses, conventional gel or plastic material, an inflatable air-retaining or liquid-retaining vessel, or other types of conventional materials for dissipating pressure across a large surface area. Pads 210 and 220 are sewn into the fabric of fingerless glove 200 in the preferred embodiment. Alternatively, pads 210 and 220 may be integrated into glove 200 as a pocket that may be later stuffed or filled with cushioning material. In another alternative embodiment, pads 210 and 220 may be affixed to fingerless glove 200 with a bonding agent or adhesive material suitable for application to a glove. In yet another alternative embodiment, pads 210 and 220 may be affixed to fingerless glove 200 with conventional hook and eye (i.e. VELCRO) strips thus providing an embodiment with removable pads 210 and 220. In other alternative embodiments, pads 210 and 220 may be fabricated from rigid materials such as plastics, fiberglass, or metal materials. It will be apparent to one of ordinary skill in the art that many other implementations of the pads 210 and 220 illustrated in FIG. 2A may be implemented according to the present invention.

Figure 2B:
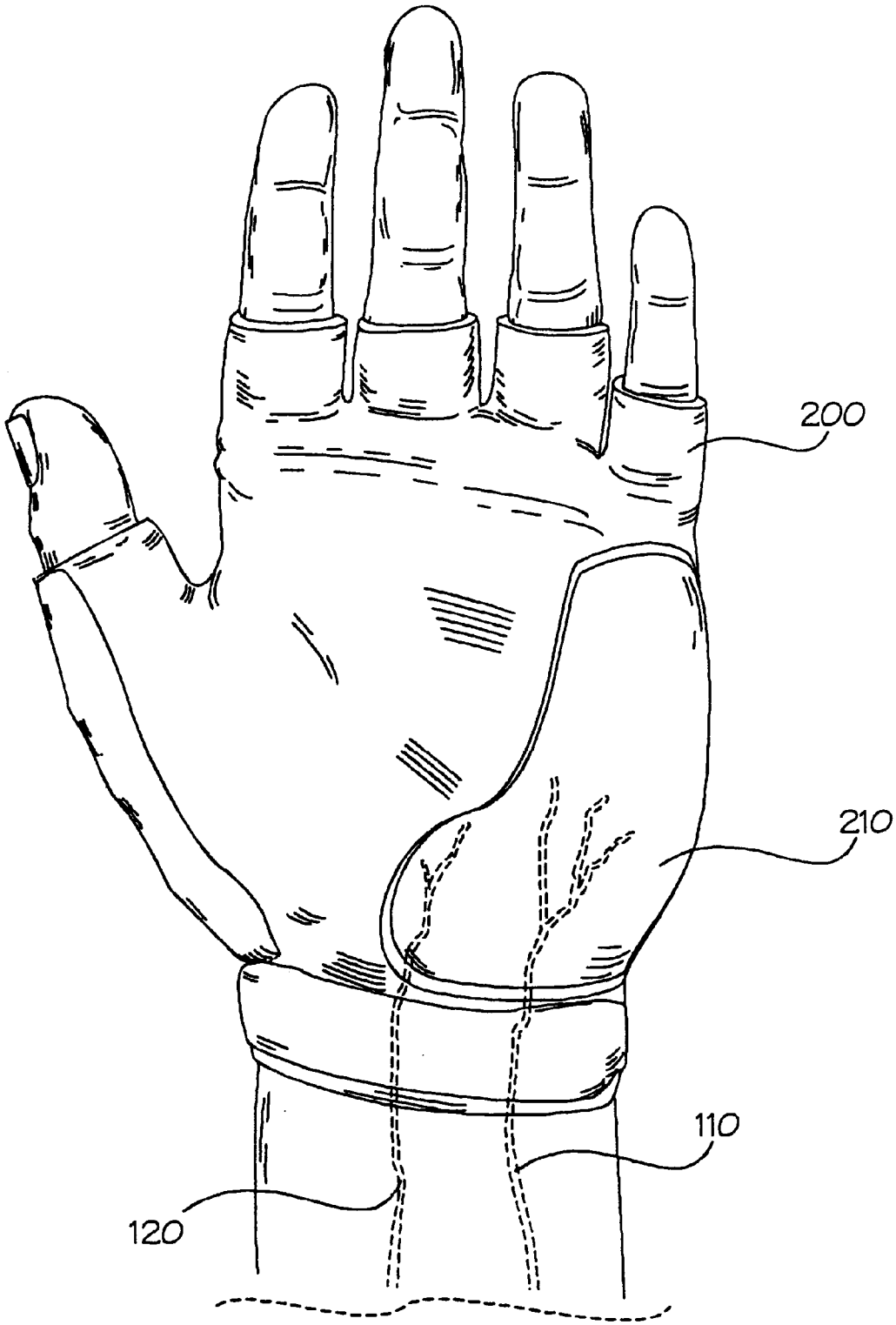
FIG. 2B illustrates an alternative embodiment of the present invention with one padded portion on the palm side of the glove.

Referring again to FIG. 2A, pads 210 and 220 are formulated in a distinctive shape similar to that illustrated in FIGS. 2A and 2B. Pad 210 is shaped with a wide portion at the lower end of glove 200 proximal to the wrist. This wide portion at the low end of pad 210 covers and protects both the Median and Ulnar nerves as they enter the hand as shown in FIGS. 2A and 2B. At the upper end of pad 210 distal to the wrist, the pad narrows to expose more of the palm, yet wraps around the hypothenar eminence to join the dorsal side of fingerless glove 200. The side portion of pad 210 is shown in more detail in FIG. 3.

Referring again to FIG. 2A, pad 220 is formulated in a distinctive shape to protect the thenar eminence and the muscular branches of the Median nerve 120. Again, the upper portion of the pad 220 distal to the wrist exposes the central area of the palm for improved hand dexterity yet extends substantially along the axis of the thumb.

By virtue of the distinctive shape of pads 210 and 220, substantial portions of the Median and Ulnar nerves are covered and protected from compression forces applied by a wearer during activities such as gripping the handlebar of a bicycle. The dissipation of this compression force by pads 210 and 220 reduces injury to the Median and Ulnar nerves and surrounding anatomy. Because of the distinctive shape and position of pads 210 and 220 in the preferred embodiment, the nerve injury to the wearer is diminished yet hand dexterity and tactile feedback of portions of the hand not requiring padding is preserved.

Referring now to FIG. 2B, an alternative of the present invention is illustrated. In the alternative embodiment illustrated in FIG. 2B, the pad 220 covering the thenar eminence is removed for better hand dexterity. Although this embodiment will not have the protective advantages of the embodiment illustrated in FIG. 2A, it is noted that both pads 210 and 220 are not necessarily required in the present invention.

Figure 3:
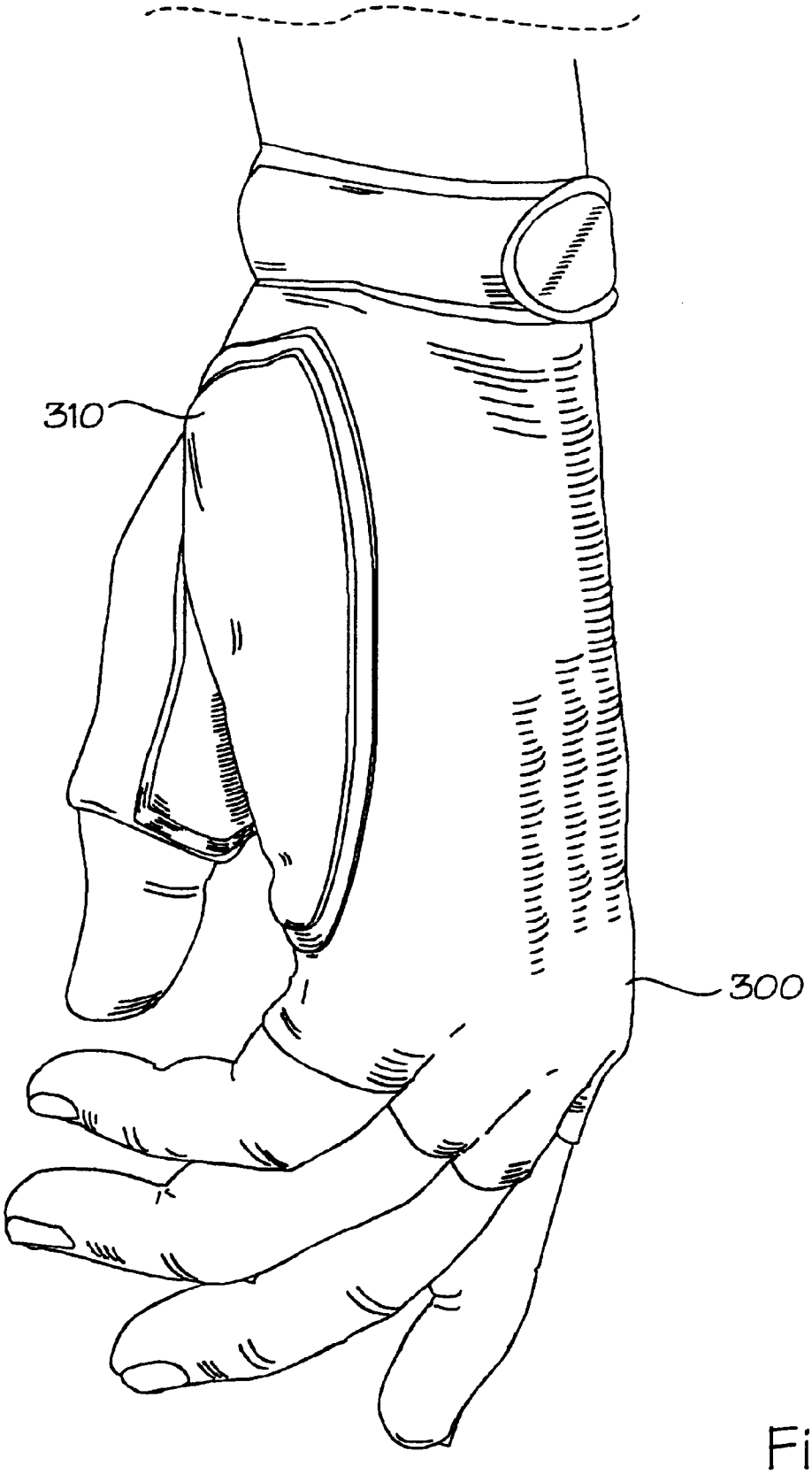
FIG. 3 illustrates a side view of the glove of the preferred embodiment.

Referring now to FIG. 3, a side view of fingerless glove 300 is illustrated. In this view, pad 310 is shown to extend from the palm side of the hand around the hypothenar eminence to join the dorsal side of glove 300. In this manner, pad 310 fully envelops the hypothenar eminence in order to achieve the hand positioning as will be described in more detail below.

Figure 4:
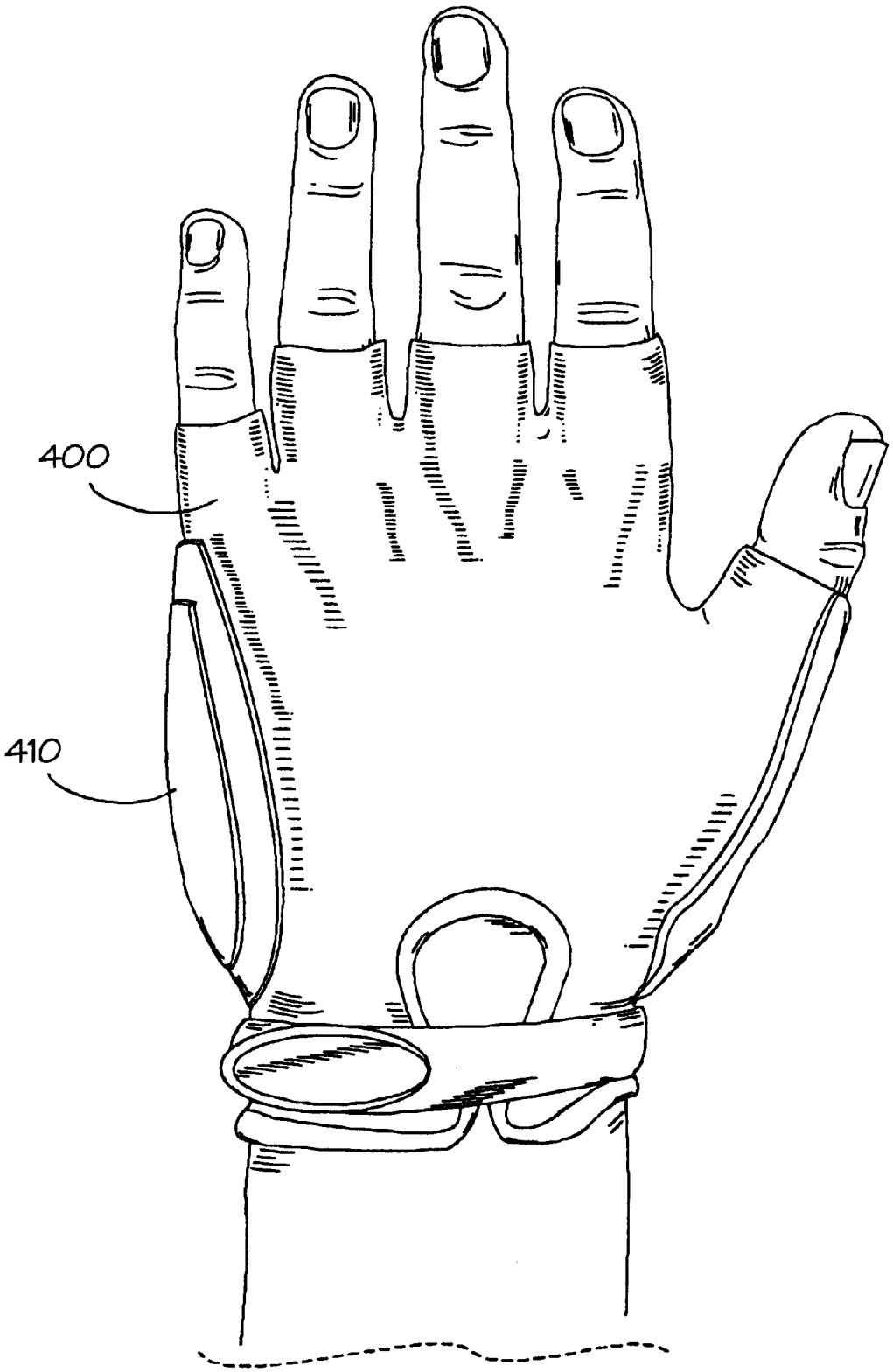
FIG. 4 illustrates a top view of the glove of the preferred embodiment.

Referring now to FIG. 4, a top view of glove 400 is shown. In this view, pad 410 is shown to wrap around the hypothenar eminence from the palm side of the glove to join the dorsal side as shown in FIG. 4.

Figure 5:
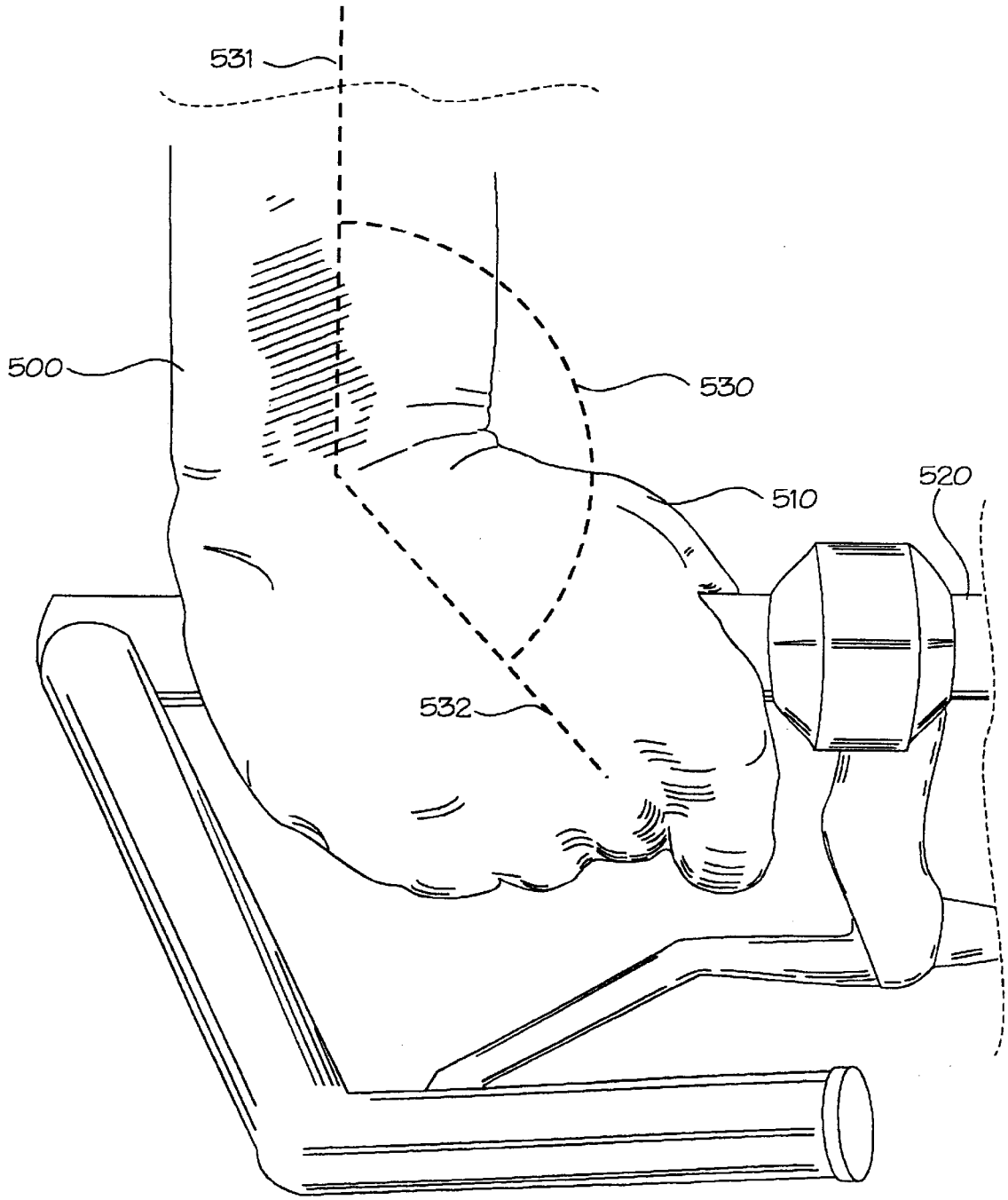
FIG. 5 illustrates a radial deviation of the wrist of a bicycle rider.

Referring now FIG. 5, a hand 500 is illustrated in a typical posture associated with holding a handlebar 520 of a bicycle. As shown in FIG. 5, a typical posture when grabbing the handlebar of a bicycle produces a radial deviation or extension shown as angle 530 between the axis of the arm 531 and the axis of the hand 532. This radial extension produces stress on the Ulnar nerve particularly when the Ulnar nerve is stretched by this radial deviation. Prolonged exposure to the improper radial deviation illustrated in FIG. 5 produces damage to the Ulnar nerve and surrounding anatomy.

Figure 6:
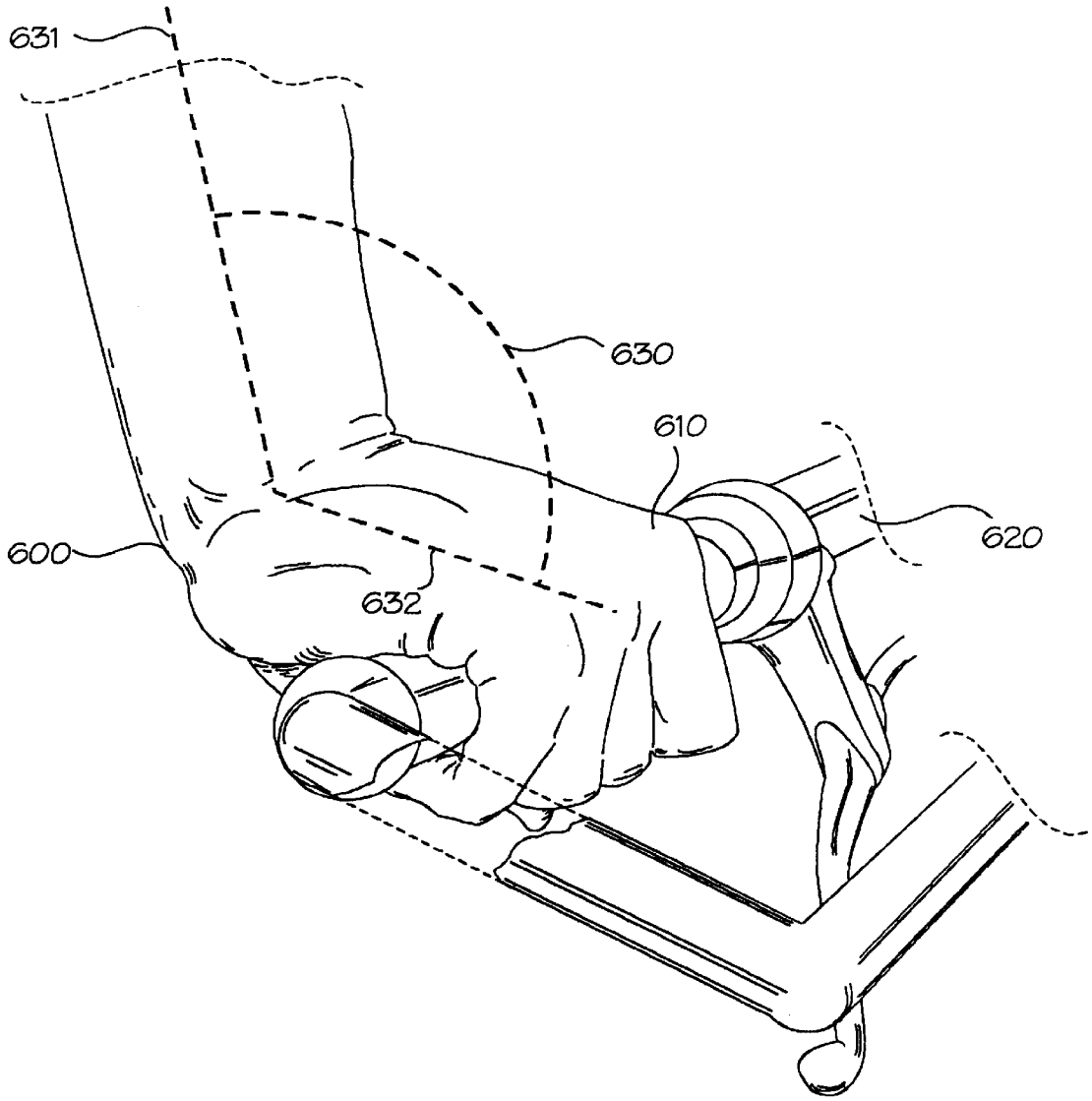
FIG. 6 illustrates the hyperextension of the wrist of a bicycle rider.

Referring now to FIG. 6, a different posture is shown for a bicycle rider gripping a handlebar 620. In the example shown in FIG. 6, the hand position 610 relative to the arm has produced a hyperextension of the wrist as shown by angle 630 relative to the axis of the arm 631 and the axis of the hand 632. Again, this hyperextension of the wrist produces stress on both the Median and Ulnar nerves as they are stretched by the hyperextension of the wrist. Prolonged exposure to the hyperextension illustrated in FIG. 6 also causes damage to the nerves and anatomy of a rider. It would be advantageous to correct the posture and hand position of a rider to eliminate both the radial deviation and the hyperextension of the wrist.

Figure 7:
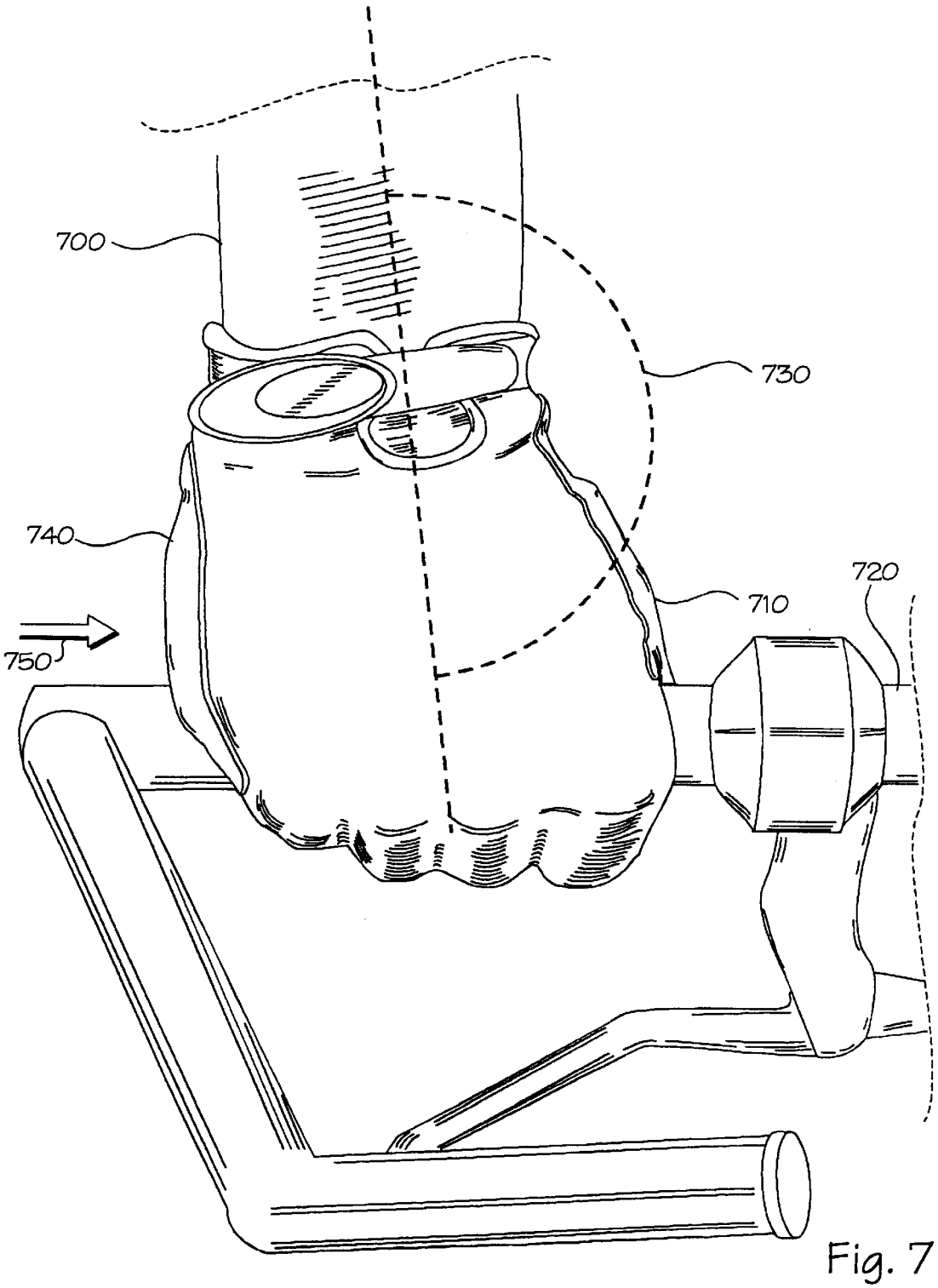
FIG. 7 illustrates the use of the preferred embodiment of the present invention to prevent radial deviation of the wrist.

Referring now to FIG. 7, the hypothenar eminence pad 740 of the preferred embodiment increases the thickness of material between the hand and the handlebar 720 at position 750 illustrated in FIG. 7. The increased thickness and density of the padding material of pad 740 produces a force on the hand illustrated as arrow 750 in FIG. 7. This force pushes the hand laterally in the direction of arrow 750 to straighten the position of the hand on handlebar 720 relative to arm 700. In this manner, the radial deviation is eliminated as indicated by angle 730. Because pad 740 serves to correctly position the hand and eliminate radial deviation, the rider is not subjected to unhealthy stress on the Ulnar nerve.

Figure 8:
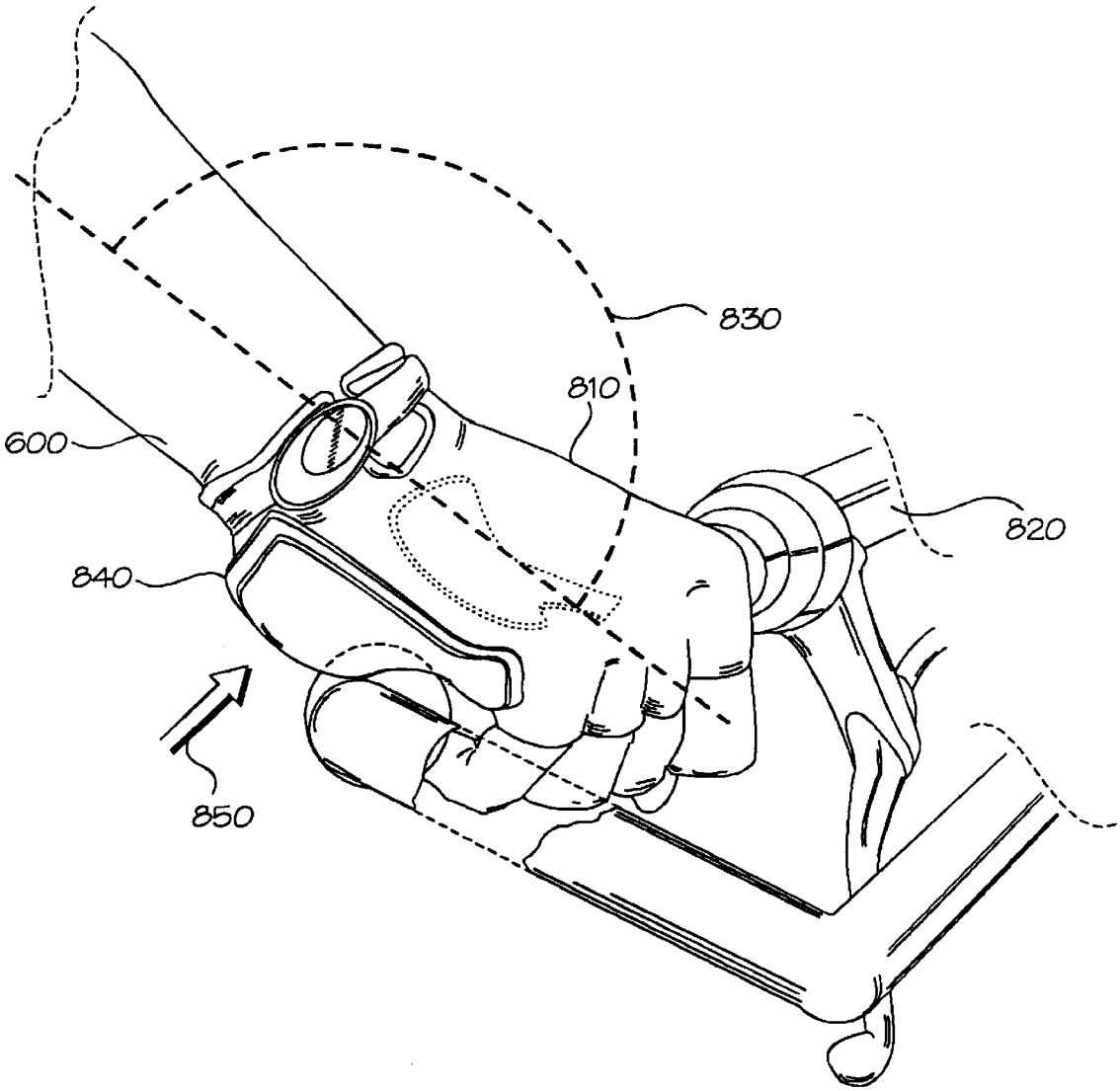
FIG. 8 illustrates the preferred embodiment of the present invention to prevent hyperextension of the wrist.

Referring now to FIG. 8, the present invention is also shown to eliminate hyperextension of the wrist of a wearer. In FIG. 8, the hypothenar eminence pad 840 is shown in contact with handlebar 820 as a rider holds the handlebar. By virtue of the thickness and density of pad 840, the pad 840 produces an upward force on the wrist as indicated by arrow 850 shown in FIG. 8. As a result of this force, the wrist is pushed upward to bring the axis of the hand in line with the axis of the arm as indicated by angle 830. Thus, the hyperextension of the wrist is eliminated by the present invention. Because the present invention eliminates hyperextension of the wrist of a rider, the rider does not suffer damage to the Median and Ulnar nerves and surrounding anatomy.

Figure 9:
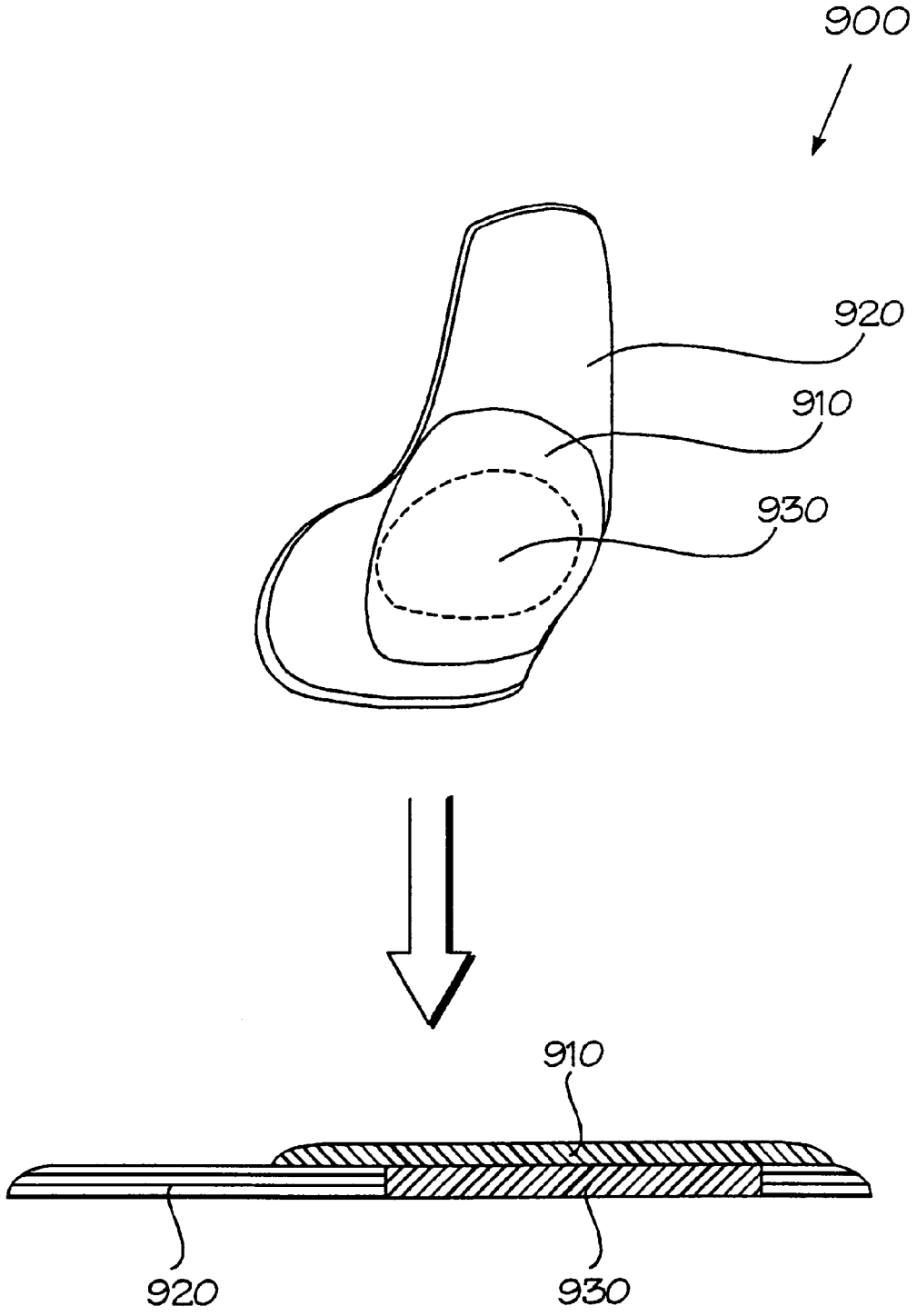
FIG. 9 is a top view of the composite multi-layer pad of the preferred embodiment.

Referring now to FIG. 9, a detailed top view of composite pad 900 in the preferred embodiment of the present invention is illustrated. Composite pad 900 is formed in a shape suitable for insertion or attachment to glove 200 as pad 210 illustrated in FIGS. 2A and 2B. In the preferred embodiment, composite pad 900 is comprised of three layers of cushioning material. In the preferred embodiment, this cushioning material is comprised of a foam rubber material of various densities as commonly available. Alternatively, the composite pad 900 may be fabricated from fabric layers, pliable plastic material, sponge, or other soft cushioning material. As shown in FIG. 9, the topmost layer 910 of composite pad 900 represents a small portion of the pad positioned at a location corresponding to the prominent position of the Ulnar nerve once pad 900 is affixed to glove 200. The second portion of pad 900 is a second layer 920 as shown in FIG. 9. Layers 910 and 920 of pad 900 may be fabricated with any standard cushioning material as described above. Layer 910 may be affixed to layer 920 using conventional bonding agents such as glues. The third layer of composite pad 900 is layer three 930, which is inserted into a preformed void in a portion of layer two 920.

Figure 10:
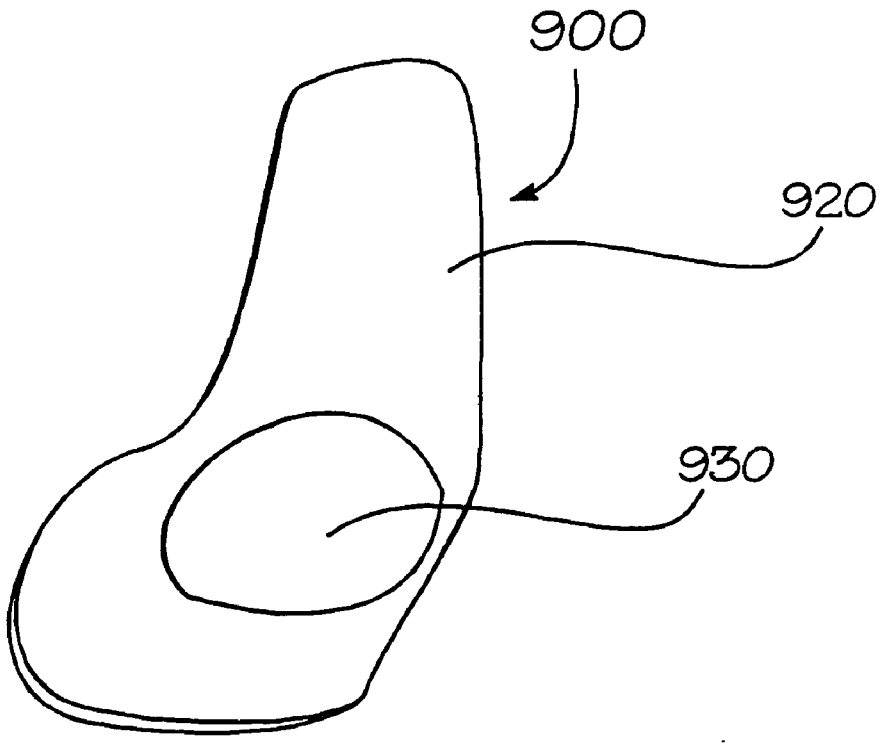
FIG. 10 is a bottom view of the composite pad.

Referring now to FIG. 10, the bottom side of composite pad 900 is illustrated. In FIG. 10, layer three 930 is shown as inserted into a void on the underside of layer 920. In the preferred embodiment, layer three 930 is fabricated from a conventional soft gel material thus providing a very soft cushion in a position corresponding to the predominant location of the Ulnar nerve once pad 900 is inserted or affixed to glove 200. Because layer 930 is inserted into a void or pocket in layer 920, the soft gel material from which layer three 930 is fabricated is contained within the pocket or void of layer 920. Thus, the cushioning effect of layer three 930 does not dissipate once compression force is applied to pad 210 of glove 200. It will be apparent to one of ordinary skill in the art that layer three 930 of pad 900 may be fabricated from any of a variety of cushioning materials other than the conventional gel material used in the preferred embodiment.

Figure 11:
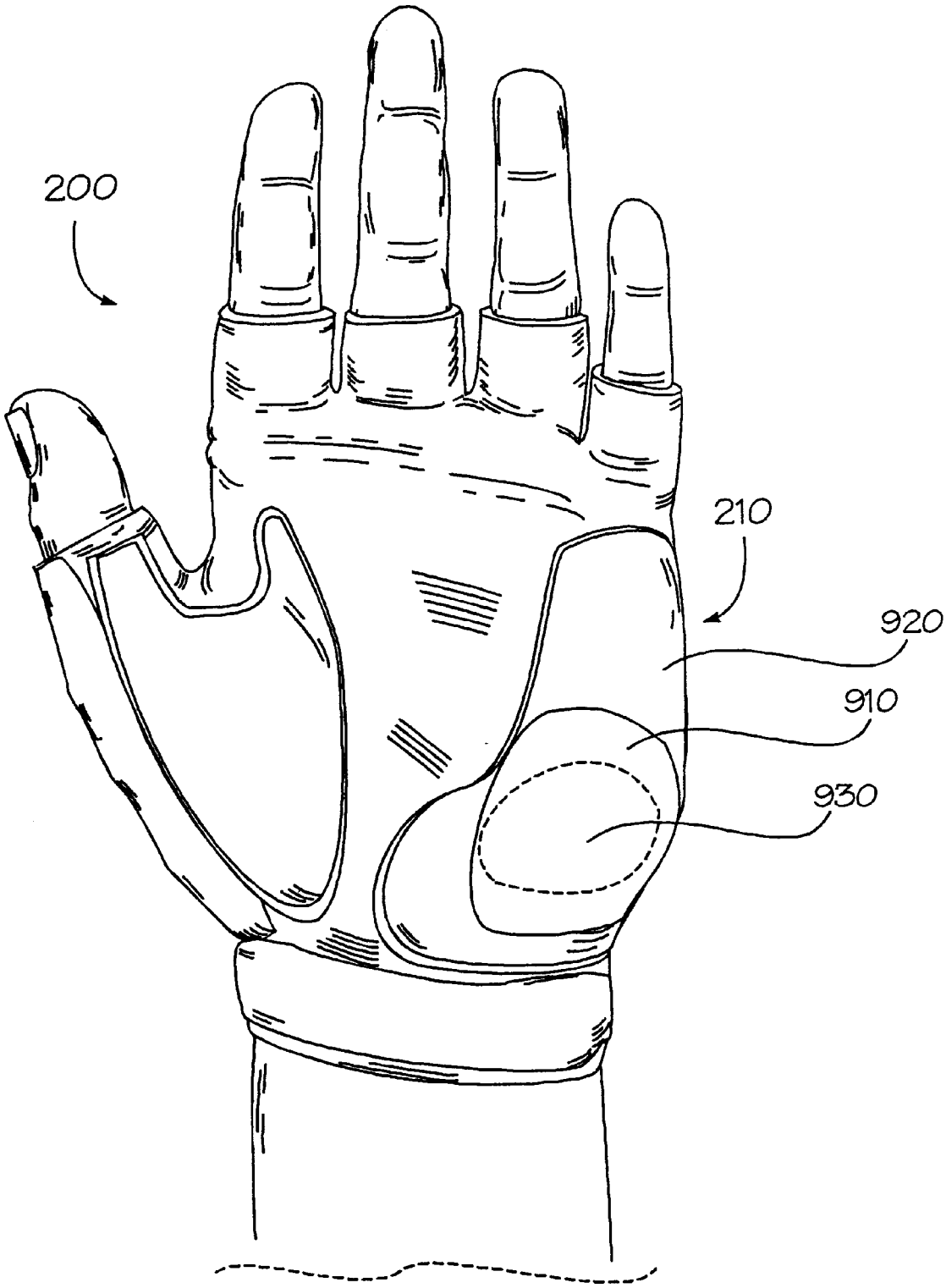
FIG. 11 illustrates the composite multi-layer pad as attached to the glove.

Referring now to FIG. 11, the positioning of pad 210 after being inserted or affixed to glove 200 is illustrated. As shown in FIG. 11, pad 210 includes layer 920 broadly covering the Median and Ulnar nerves and the hypothenar eminence, layer 910 located in the predominant position of the Ulnar nerve, and layer 930 also located in the prominent position of the Ulnar nerve and providing an additional soft layer of cushioning material to protect the Ulnar nerve from damage by compression forces.

Thus, a padded glove for protecting and properly positioning the hand of a wearer is disclosed. Although the present invention has been described with reference to specific exemplary embodiments, it will be apparent to those of ordinary skill in the art that various modifications and augmentations may be made to these embodiments without departing from the broader spirit of the scope of the present invention as set forth in the following claims.

What is claimed is:

1. A method of protecting the hand of a bicycle rider when the rider grasps a bicycle handlebar, said method comprising:

interposing a first pad between the hand and the handlebar, said first pad being adapted to substantially cover the thenar eminence of the hand; and exposing the upper and central palm of the rider's hand to substantially unpadded contact with the handlebar.

2. The method of claim 1, wherein said first pad is adapted to cover at least a portion of the median nerve of the hand.

* * * * *